United States Patent [19]

Krieger et al.

[11] Patent Number: 4,597,557

[45] Date of Patent: Jul. 1, 1986

[54] HYDRAULICALLY-CONTROLLED NON-RETURN VALVE

[75] Inventors: Karl Krieger; Jochem Hartleb, both of Wuppertal; Werner Reinelt, Bochum, all of Fed. Rep. of Germany

[73] Assignee: Hermann Hemscheidt Maschinenfabrik GmbH & Co., Wuppertal, Fed. Rep. of Germany

[21] Appl. No.: 708,032

[22] Filed: Mar. 1, 1985

[30] Foreign Application Priority Data

Mar. 2, 1984 [DE] Fed. Rep. of Germany ..... 3407878

[51] Int. Cl.[4] ..... F16K 31/124; F15B 13/042

[52] U.S. Cl. ..... 251/63.4; 91/420; 137/493; 251/25

[58] Field of Search ..... 251/25, 63.4, 47, 51, 251/55; 91/189 R, 420; 137/513.3

[56] References Cited

U.S. PATENT DOCUMENTS

| | | | |
|---|---|---|---|
| 4,006,663 | 2/1977 | Baatrup et al. | 91/420 X |
| 4,076,210 | 2/1978 | Spielvogel | 251/63.4 X |
| 4,323,092 | 4/1982 | Acerbi | 91/420 X |
| 4,461,449 | 7/1984 | Turner | 91/420 X |

*Primary Examiner*—Arnold Rosenthal

*Attorney, Agent, or Firm*—Berman, Aisenberg & Platt

[57] ABSTRACT

An hydraulically-controlled non-return valve for the hydraulic cylinders of a walking mine-roof support is provided with a cylindrical valve-closing member which is spring-loaded in the closing direction and is guided in a valve case in a valve housing, the valve-closing member being sealed off therein by means of a seal. A space on one face of the valve-closing member is connected to a circulating duct by way of a stepped bore in the valve case, which bore contains a spring-loaded throttle member having through-flow bores of which one has a throttle-like reduced cross-section. During setting of the hydraulic cylinder pressurized fluid flows past the opened valve-closing member through inclined bores and, by way of the circulating duct, to the stroke space of the hydraulic cylinder. During retraction of the hydraulic cylinder, a control piston in the non-return valve is loaded at the same time as an annular space in the hydraulic cylinder. The control piston thus lifts the valve-closing member from a valve seat so that the pressurized fluid flows back in the reverse direction. The said space bounding the valve-closing member is connected to the throttle member in such a manner that the valve-closing member is not caused to oscillate by the pressurized fluid flowing back during retraction of the hydraulic cylinder.

3 Claims, 1 Drawing Figure

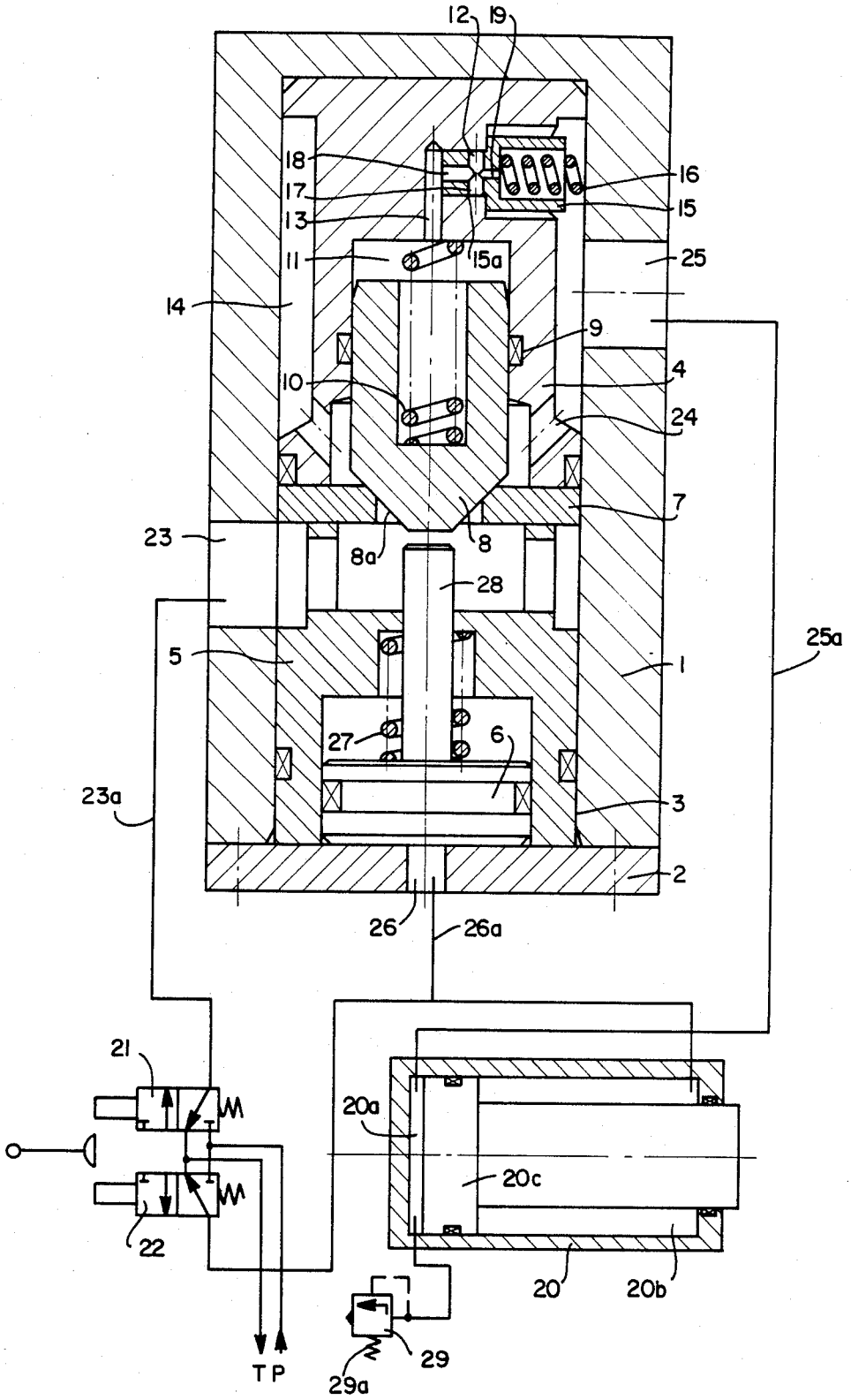
12
19
18
17
13
11
15a
16
15
25
14
9
4
10
24
7
23
8a
8
28
25a
5
1
27
6
23a
3
2
26
26a
21
20a
20c
22
20
20b
TP
29
29a

HYDRAULICALLY-CONTROLLED NON-RETURN VALVE

This invention concerns an hydraulically-controlled non-return valve for the hydraulic props or rams of walking mine-roof supports.

DE-AS No. 28 30 510 discloses a valve arrangement for setting an hydraulic prop or ram wherein the stroke space of the prop or ram is protected by a non-return valve which can be opened hydraulically. The valve-closing member takes the form of a spring-loaded valve cone which is guided along its cylindrical outer surface in the valve housing and is displaceable into the opening position by an hydraulically-loadable control piston with a control step. During setting of the prop or ram, the valve-closing member is pushed into the opening position against the force of the valve spring by pressurized fluid flowing in from a high-pressure line. The pressurized fluid flows back in the opposite direction when the valve-closing member, upon retraction of the prop or ram, is lifted from the valve seat by the control piston and its stem. By means of this valve arrangement, a pressure-limiting valve which is also connected to the stroke space of the prop or ram is separated from the high pressure line by a pressure-controlled 2-port/2-way valve on commencement of the setting operation and is reconnected to the high-pressure line after the setting operation has been completed. For the purpose of closing the valve, a pressure chamber receives pressurized fluid by way of the control piston of the valve. To avoid pressure being applied to the pressure-limiting valve in a sudden manner, a throttle zone is provided in the pressure-medium line leading to the pressure chamber of the control piston.

DE-PS No. 30 48 229 describes a non-return valve with a control piston of stepped cross-section and a valve-closing member arranged parallel thereto which is located between an annular space bounding the control piston at one side and the flow path leading to the stroke space of a prop or ram. After the prop or ram has been set, the faces of equal size are loaded at both sides of the control piston so that pressure is equalized and undesirable opening of the valve-closing member is avoided. During retraction of the prop or ram, it is acted upon, with the help of a cut-off valve, on different effective faces by pressurized control fluid and by pressurized fluid flowing from the prop or ram to the return line. This system is aimed at absorbing the effects of impacts due to the relief of tension which are caused, when the non-return valve begins to operate, by pressurized fluid flowing from the prop or ram into the return line in a large quantity and at high velocity. Because of the sudden drop in pressure and the alternating pressure effect of the control piston, considerable fluctuations in pressure with high peaks are caused. Oscillations in pressure at frequencies of up to 2000 Hz cause the non-return valve to "flutter". These high loads shorten the service-life of the non-return valve and also of the connected pressure-limiting valve and of the entire hydraulic system.

To avoid such impacts caused by relief of tension, DE-OS No. 31 04 362 proposes a non-return valve which can be hydraulically opened and wherein biassing valve is arranged in the connection leading to the control-pressure space of the pilot piston, the biassing pressure being set at a level higher than the maximum pressure head possible in the return line. However, the means for acting upon the control piston are costly and, furthermore, the action is difficult to regulate.

On page 5 of "Kurznachrichten" No. 91, December 1973, issued by the Steinkohlenbergbauverein in the German Federal Republic, details are given of a non-return valve which can be opened hydraulically and in which the impacts due to relief of tension that occur when bringing the non-return valve into action are intended to be avoided to a large extent by means of a gradual change in cross-section in the stroke zone of a throttle cone. A disadvantage of this arrangement is that the throttle cone greatly reduces the flow cross-section of the valve so that the sealing faces are sub-Jected to heavy wear. Furthermore, with a maximum through-flow of 40 litres/min, the valve is suitable only for protecting rams having relatively small cross-sectional faces. The "throttle bore" formed in the peripheral face of the valve-closing member is of no practical importance as regards the functioning of mass-produced valves, since, as a result of manufacturing tolerances, the gap formed between the valve-closing member and the valve case has a considerably greater cross-section than the bore itself.

It is therefore an aim of the present invention to design a non-return valve which can be opened hydraulically and which consists of simple components and is balanced as regards pressure so that the valve-closing member can be displaced without pronounced oscillations due to impacts resulting from the relaxation of tension.

According to the invention, this aim is achieved by the means stated in claim 1 of the claims of this specification. Advantageous embodiments of the invention form the subject-matter of the subsidiary claims.

An example of an hydraulically-controlled non-return valve in accordance with the invention is shown in the accompanying drawing which shows the valve in longitudinal section.

The valve comprises a valve housing 1 provided with an inner bore 3 closed by a cover 2, the bore serving to accommodate a valve case 4 and a guide sleeve or cylinder 5 for a control piston 6. Arranged between the valve case 4 and the guide sleeve 5 is a valve seat 7 on which is seated a conical sealing face 8*a* of a hollow, longitudinally-displaceable cylindrical valve-closing member 8 lying in the hollow space 11 of the valve case 4. The outer cylindrical surface of the member 8 is guided by an internal cylindrical surface of the valve case 4 and is sealed off by an O-ring 9. A valve spring 1O located in the hollow space of the valve-closing member 8 and abutting against the valve case 4 urges the member 8 in the closing direction and presses it against the valve seat 7.

Within the valve case 4—above the space 11 and the valve-closing member 8—are a radially-directed stepped bore 12 and a longitudinally-extending branch bore 13 which connects the space 11 to the reduced end of the stepped bore 12. The latter leads into an annular circulating duct 14 on the peripheral surface of the valve case 4.

Inserted with radial clearance in the stepped bore 12 is a cup-like throttle member 15 with a stem 15*a*. The throttle member 15 is loaded by a spring 16 abutting against the inner cylindrical surface of the valve housing 1. A cruciform arrangement of through-flow ducts 17, 18, 19 extends through the stem 15*a* of the throttle member 15. The transverse duct 17 and the longitudinal duct 18 (which discharges into the branch bore 13) have through-flow cross-sections which are of the same size and are greater than that of the longitudinal duct 19 which leads into the hollow space of the cup of the member 15. The duct 19, being of reduced cross-section, therefore acts as a throttle passage. When the valve-closing member 8 is opened, the throttle member 15 is displaced, against the force of the spring 16, by pressurized fluid which enters the stepped bore 12 from the space 11 as the valve-closing member moves upwards. Outward displacement of the throttle member 15 results in the transverse duct 17 opening into the enlarged-section portion of the stepped bore 12, thereby allowing hydraulic fluid to pass into the annular circulating duct 14.

An hydraulic prop or ram 20 of a walking mine-roof support is protected by the non-return valve described above. The prop or ram 20 is connected to two 3-port/2-way valves 21, 22, which alternately connect the stroke space 20*a* and the annular space 20*b* of the ram 20 to a high pressure line P and a return line T. Pressurized fluid is passed through the 3-port/2-way valve 21 from the high-pressure line P to an inlet opening 23 in the valve housing 1 via a pipe-line 23*a*. The pressurized fluid acts on the lower surface of the closing member 8 and lifts the latter from the valve seat 7 against the force of the valve spring 10. The pressurized fluid thus flows round the conical nose of the member 8 and through inclined bores 24 into the circulating duct 14. The fluid then leaves the non-return valve through an outlet opening 25 which is connected by a pipe-line 25*a* to the stroke space 20*a* of the ram 20. As the piston 20*c* of the prop or ram 20 moves to the right, pressurized fluid is forced out of the annular space 20*b* therein and into the return line T by way of the 3-port/2-way valve 22.

After setting of the prop or ram 20, the valve-closing member 8 of the non-return valve comes to rest again on the valve seat 7 under the action of the spring 1O. The stroke space 20*a* of the ram 20 is now protected by the 3-port/2-way valve 21 which, in the zero position, is opened to the non-return line T. The stroke space 20*a* of the ram 20 is also protected against loads emanating from the mine roof by means of a pressure-limiting valve 29 provided with a spring 29*a* which biasses the valve into a closing position.

When the prop or ram 20 is retracted, pressurized fluid is passed by way of the 3-port/2-way valve 22 from the high-pressure line P to the annular space 20*b* in the ram 20 and, at the same time via a pipe-line 26*a*, to a control connection 26 in the housing 1 of the non-return valve. The control piston 6, acted upon by this pressurized fluid, moves upwards against the force of the spring 27 so that a control stem 28 connected to and extending upwards from the control piston 6 lifts the closing member 8 from its valve seat 7 against the force of the valve spring 10. Some pressurized fluid which displaces the throttle member 15 against the force of the spring 16 is forced into the circulating duct 14 by way of the transverse duct 17 and the longitudinal duct 18. However, the throttle member 15 is then immediately pushed back into the stepped bore 12 by the spring 16 so that the space 11 is left in direct communication with the circulating duct 14 only by way of the longitudinal duct 19 of reduced cross-section. The pressurized fluid which flows back through the outlet opening 25, following initiation of the ram or prop retraction operation, cannot therefore act directly on the pressure face of the valve-closing member 8 that is remote from the valve seat 7, and that fluid cannot cause the valve-closing member to oscillate.

Expressed differently, the non-return valve described above has a valve-closing member 8 which is sealed off by the inner cylindrical surface of the valve case 4 and by the seal 9. When the member 8 is opened, the pressurized fluid present in the sealed-off space 11 within the valve case 4 is forced, by way of the comparatively large cross-section through-flow bores 17 and 18 in the throttle member 15, into the circulating duct 14 which is open to the return line 25*a*. The valve-opening operation is in no way adversely affected by the seal since pressure is normally balanced at both sides of the valve-closing member 8 and the throttle member 15. The throttle member 15 is pressed back into the stepped recess 12 by the spring 16 so that the ends of the transverse bores 17 are covered again. The circulating duct 14 is then connected to the sealed-off space 11 only by way of the longitudinal bore 19 which is of reduced section so as to form a throttle. A tension-relaxation impact emanating from the stroke space 20*a* of the prop or ram 20 and occurring when the valve is opened is applied to the valve-closing member 8 held in the opening position in this way. The surge of fluid which occurs does not act immediately by way of the reduced-section bore 19 in the throttle member but is delayed so that displacement of the valve-closing member 8 in the closing direction does not take place. Conversely, the pressurized fluid contained in the space 11 between the member 8 and the throttle member 15 causes displacement in the opposite direction because of a sudden rise in pressure.

The invention accordingly makes use of the pressurized fluid present in the space 11 for the purpose of steadying the opened valve-closing member 8 when tension-relaxation impacts occur. The non-return valve is particularly suitable for low-viscosity HFA hydraulic fluids, since only a small quantity of pressurized fluid is exchanged by way of the throttle member 15. Furthermore, there is virtually no exchange of fluid through the reduced-section longitudinal bore 19 of the throttle member 15; instead the pressure is simply balanced. The non-return valve in accordance with the invention therefore operates very reliably, and its construction is simple and has no effect upon the shape of the valve-closing member 8 and of the valve seat 7 which can be designed without restriction to suit the required through-flow quantity.

We claim:

1. A hydraulically-controllable non-return valve for the hydraulic cylinders of walking mine-roof supports, comprising a valve housing, a valve case accommodated in said valve housing, a generally cylindrical valve-closing member arranged for sliding longitudinal displacement in said valve case, a valve seat in said valve housing, a tapered sealing face on said valve-closing member adapted to seat on said valve seat, a valve spring acting on said valve-closing member to load said valve-closing member to a closing position, an hydraulically-loadable control piston arranged for longitudinal displacement in said valve housing, a control stem on said control piston adapted to abut and thereby move said valve-closing member away from the valve seat, a seal between said valve-closing member and said valve case, a space for hydraulic fluid in said valve case on that side of the valve-closing member remote from the valve seat, a circulating duct in said valve housing, a stepped bore in said case, a branch bore in said case connecting said space for hydraulic fluid to the smaller end of said stepped bore, a cup-like flow-regulating member arranged for longitudinal movement in said stepped bore, a stem fixed on said cup-like member and likewise arranged for movement in said stepped bore, a spring acting on said cup-like member, and a cruciform arrangement of through-flow ducts in said stem, said through-flow ducts in said stem comprising a transverse duct and a first longitudinal duct on one side thereof having through-flow cross-sections which are of substantially the same size as each other and a second longitudinal duct of smaller cross-section than said first longitudinal duct arranged on the opposite side of said transverse duct, said first longitudinal duct being in communication with said branch bore in said case and said second longitudinal duct being in communication with said circulating duct in said valve housing.

2. An hydraulically-controlled non-return valve according to claim 1, wherein said spring acting on said cup-like flow-regulating member urges said member into a position where said transverse duct in said stem lies in the smaller portion of said stepped bore.

3. An hydraulically-controlled non-return valve according to claim 1 comprising a cavity in said valve case adjacent said valve seat, wherein said circulating duct is arranged on the outer surface of the valve case and wherein inclined bores in said valve case extend from said circulating duct to said cavity.

* * * * *